US008917999B2

(12) United States Patent
Takada et al.

(10) Patent No.: US 8,917,999 B2
(45) Date of Patent: Dec. 23, 2014

(54) IMAGE HEATING APPARATUS EXECUTING A RUBBING OPERATION OF A ROTATABLE RUBBING MEMBER ON A ROTATABLE HEATING MEMBER

(75) Inventors: Shigeaki Takada, Abiko (JP); Oki Kitagawa, Kashiwa (JP); Akiyoshi Shinagawa, Kashiwa (JP); Hiroki Kawai, Toride (JP)

(73) Assignee: Canon Kabushiki Kaisha, Tokyo (JP)

( * ) Notice: Subject to any disclaimer, the term of this patent is extended or adjusted under 35 U.S.C. 154(b) by 196 days.

(21) Appl. No.: 13/599,164

(22) Filed: Aug. 30, 2012

(65) Prior Publication Data

US 2013/0058672 A1 Mar. 7, 2013

(30) Foreign Application Priority Data

Sep. 1, 2011 (JP) ..... 2011-190723

(51) Int. Cl.
*G03G 15/20* (2006.01)

(52) U.S. Cl.
CPC ..... *G03G 15/2025* (2013.01)
USPC ..... 399/43; 399/67; 399/320; 399/328

(58) Field of Classification Search
CPC ..... G03G 15/2003; G03G 15/2025; G03G 15/2039; G03G 15/2046; G03G 15/2064; G03G 15/2075
USPC ..... 399/43, 67, 69, 320, 327, 328, 330, 333
See application file for complete search history.

(56) References Cited

U.S. PATENT DOCUMENTS 7,200,354 B2 4/2007 Nakamoto et al.
7,430,392 B2 9/2008 Ito et al.
7,457,576 B2 11/2008 Takada et al.
7,460,821 B2 * 12/2008 Ai et al. ..... 399/328
7,466,950 B2 12/2008 Matsuura et al.
7,596,348 B2 9/2009 Nakamoto et al.

(Continued)

FOREIGN PATENT DOCUMENTS

CN 101122772 A 2/2008
JP 4-350887 A 12/1992

(Continued)

OTHER PUBLICATIONS

Chinese Office Action dated Oct. 22, 2014, issued in counterpart Chinese Application No. 201210317118.8, and English-language translation thereof.

*Primary Examiner* — William J Royer

(74) *Attorney, Agent, or Firm* — Fitzpatrick, Cella, Harper & Scinto

(57) ABSTRACT

An image heating apparatus includes a rotatable heating member for heating an image on a recording material in a nip; a nip-forming member for forming the nip together with the heating member; a rotatable rubbing member for rubbing the heating member; a temperature sensor for detecting a temperature of the heating member; a moving mechanism for moving the rubbing member from a position where it is spaced from the heating member to a position where it rubs a surface of the heating member; and a controller for executing, by moving the rubbing member to the position where it rubs the surface of the heating member, a rubbing operation such that the rubbing member rubs the surface of the heating member. The controller executes the rubbing operation depending on the temperature detected by the temperature sensor when the recording material passes through the nip.

9 Claims, 6 Drawing Sheets

(56) References Cited

U.S. PATENT DOCUMENTS

| | | | | |
|---|---|---|---|---|
| 7,844,208 | B2 | 11/2010 | Hayashi et al. | |
| 7,941,084 | B2 * | 5/2011 | Li et al. | 399/328 |
| 7,962,080 | B2 * | 6/2011 | Kameda | 399/328 |
| 8,208,833 | B2 | 6/2012 | Kitagawa | |
| 8,301,067 | B2 | 10/2012 | Takada | |
| 2008/0038026 | A1 | 2/2008 | Ai et al. | |
| 2008/0038027 | A1 | 2/2008 | Ito et al. | |
| 2009/0196637 | A1 | 8/2009 | Inomata | |
| 2009/0297233 | A1 | 12/2009 | Kameda | |
| 2010/0284713 | A1 | 11/2010 | Li et al. | |
| 2012/0003346 | A1 | 1/2012 | Chigono et al. | |
| 2012/0027444 | A1 | 2/2012 | Kitagawa | |
| 2012/0155940 | A1 | 6/2012 | Hagiwara et al. | |
| 2012/0251153 | A1 | 10/2012 | Takada | |

FOREIGN PATENT DOCUMENTS

| | | | |
|---|---|---|---|
| JP | 2008-40363 | A | 2/2008 |
| JP | 2008-40365 | A | 2/2008 |
| JP | 2008-268606 | A | 11/2008 |
| JP | 2011-123340 | A | 6/2011 |

* cited by examiner

IMAGE HEATING APPARATUS EXECUTING A RUBBING OPERATION OF A ROTATABLE RUBBING MEMBER ON A ROTATABLE HEATING MEMBER

FIELD OF THE INVENTION AND RELATED ART

The present invention relates to an image heating apparatus, for heating a toner image on a recording material, to be mounted in an image forming apparatus such as a copying machine, a printer or a facsimile machine. Particularly, the present invention relates to the image heating apparatus including a rotatable rubbing member capable of rubbing a rotatable heating member for heating the toner image on the recording material.

The image heating apparatus including the rotatable heating member and a nip-forming member for forming a nip in which the toner image on the recording material is to be heated has been conventionally used.

However, of the recording materials, there is a recording material having an edge where a projection, which is called a projected edge, is formed. When the recording material passes through the nip, there is a possibility that the edge of the recording material leaves a minute trace of abrasion on the rotatable heating member. With respect to a widthwise direction perpendicular to a recording material conveyance direction, a recording-material-edge passing portion is concentrated, so that there is a possibility that the minute trace of abrasion due to the projected edge is locally formed. As a result, there is a possibility of an occurrence of uneven glossiness of an image.

Therefore, as a countermeasure against the trace of abrasion due to the projected edge, Japanese Laid-Open Patent Application (JP-A) 2008-40363 discloses a method in which a rubbing member rubs the rotatable heating member. In order to suppress shortening of the life of the rotatable heating member, the rubbing member is spaced from the rotatable heating member usually and when a predetermined number of sheets of the recording material passes through the nip, the rubbing member as a contact member is contacted to the rotatable heating member to execute an operation in which the rubbing member rubs the rotatable heating member.

However, when the temperature of the rotatable heating member is increased, the rotatable heating member is in a state in which the strength of the rotatable heating member itself is lowered. In this state, when the rubbing operation is executed with the same interval as that in the case where the temperature is low, there is a possibility that the trace of abrasion left on the rotatable heating member by the projected edge of paper becomes deep. As a result, there is a possibility that uneven glossiness is caused to occur.

SUMMARY OF THE INVENTION

A principal object of the present invention is to provide an image heating apparatus capable of suppressing the deep trace of abrasion left on a rotatable heating member by a projected edge of paper even when the temperature of the rotatable heating member is increased in a constitution in which a rubbing member rubs the rotatable heating member as a countermeasure against the trace of abrasion by the projected edge.

According to an aspect of the present invention, there is provided an image heating apparatus comprising: a rotatable heating member for heating an image on a recording material in a nip; a nip-forming member for forming the nip together with the rotatable heating member; a rotatable rubbing member for rubbing the rotatable heating member; a temperature sensor for detecting a temperature of the rotatable heating member; a moving mechanism for moving the rotatable rubbing member from a position where it is spaced from the rotatable heating member to a position where it rubs a surface of the rotatable heating member; and a controller for executing, by moving the rotatable rubbing member to the position where it rubs the surface of the rotatable heating member, a rubbing operation such that the rotatable rubbing member rubs the surface of the rotatable heating member, wherein the controller executes the rubbing operation depending on the temperature detected by the temperature sensor when the recording material passes through the nip.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

Hereinbelow, embodiments of the present invention will be described in detail with reference to the drawings. The present invention can also be carried out in other embodiments in which a part or all of constituent elements in the following embodiments are replaced with their alternative constituent elements so long as the total rubbing (abrasion) amount of a rotatable heating member is lowered with a lower temperature of the rotatable heating member at a non-sheet-passing portion.

Therefore, an image heating apparatus includes not only a fixing device for fixing a toner image on a recording material by heating the recording material on which the toner image is transferred, but also an image adjusting device for imparting a desired surface property to an image by heating a partly or completely fixed toner image. Further, a glossing device for improving the glossiness of an image by re-heating the image fixed on the recording material is also included. The rotatable heating member and a rotatable pressing member may be any combination of an endless belt and a roller member. Control in the present invention may also be carried out by disposing a rubbing device in a state in which the rotatable pressing member is regarded as the rotatable heating member.

An image forming apparatus is capable of mounting therein the image heating apparatus of the present invention irrespective of the types of monochromatic/full-color, devices, sheet-feeding/recording material conveyance/intermediary transfer devices, toner image forming methods, and the transfer methods. In the following embodiments, only a principal portion concerning formation/transfer of the toner image will be described, but the present invention can be carried out in image forming apparatuses with various uses including printers, various printing machines, copying machines, facsimile machines, multi-function machines, and the like by adding necessary equipment, options, or casing structures.

<Image Forming Apparatus>

Figure 1:
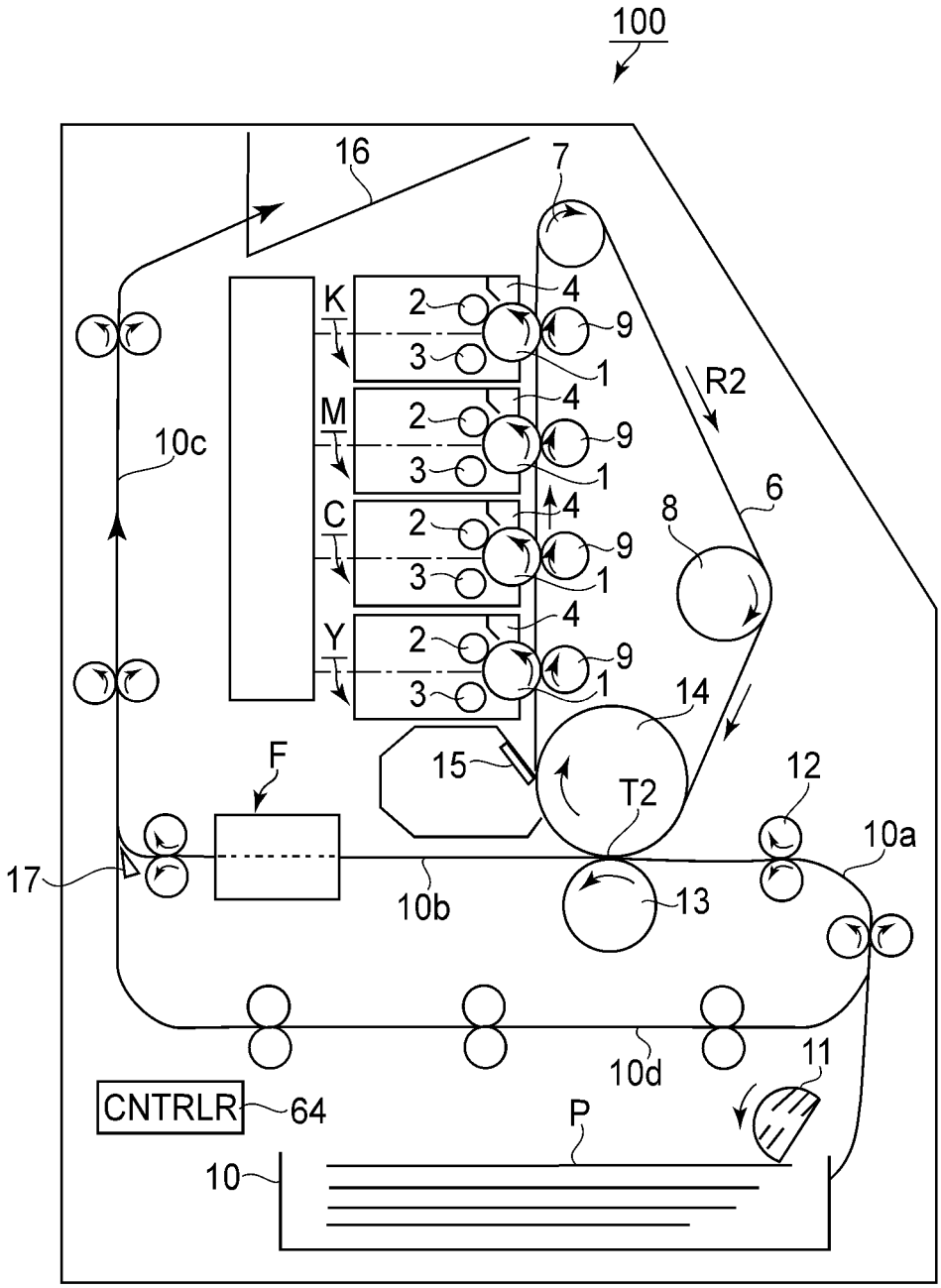
FIG. 1 is an illustration of a structure of an image forming apparatus.

FIG. 1 is an illustration of structure of an image forming apparatus. As shown in FIG. 1, an image forming apparatus 100 in this embodiment is a tandem-type full-color printer of an intermediary transfer type in which image forming portions Y, C, M and K for yellow, cyan, magenta and black, respectively, are arranged along an intermediary transfer belt 6.

In the image forming portion Y, a yellow toner image is formed on a photosensitive drum 1(Y) and then is transferred onto the intermediary transfer belt 6. In the image forming portion C, a cyan toner image is formed on a photosensitive drum 1(C) and is transferred onto the intermediary transfer belt 6. In the image forming portions M and K, a magenta toner image and a black toner image are formed on photosensitive drums 1(C) and 1(K), respectively, and are transferred onto the intermediary transfer belt 6.

The intermediary transfer belt 6 is constituted by an endless resin belt and is stretched by a driving roller 7, a secondary transfer opposite roller 14 and a tension roller 8 and is rotationally driven in an arrow R2 direction by the driving roller 7. A recording material P is taken out from a recording material cassette 10 one by one by a sheet feeding roller 11 and is in a stand-by state between registration rollers 12. The recording material P is sent by the registration rollers 12 to a secondary transfer portion T2, so that the toner images are transferred onto the recording material P. The recording material P on which the four color toner images are transferred is conveyed into a fixing device F, and is, after being heated and pressed by the fixing device F to fix the toner images on its surface, discharged onto an external tray 16 through a discharging conveying path 10*c*. Incidentally, the image forming apparatus includes conveying paths 10*a*, 10*b*, a cleaning blade 15 and a flapper 17.

The image forming portions Y, C, M and K have the substantially same constitution except that the colors of toners of yellow, cyan, magenta and black used in developing devices 3(Y), 3(C), 3(M) and 3(K) are different from each other. In the following description, the image forming portion Y will be described and a description of the other image forming portions C, M and K will be omitted as being redundant.

The image forming portion Y includes the photosensitive drum 1 around which a charging roller 2, an exposure device 5, the developing device 3, a transfer roller 9, and a drum cleaning device 4 are provided. The charging roller 2 electrically charges the surface of the photosensitive drum 1 to a uniform potential. The exposure device 5 writes (forms) an electrostatic image for an image on the photosensitive drum 1 by scanning with a laser beam. The developing device 3 develops the electrostatic image to form the toner image on the photosensitive drum 1. The transfer roller 9 is supplied with a DC voltage, so that the toner image on the photosensitive drum 1 is transferred onto the intermediary transfer belt 6.

<Fixing Device>

Figure 2:
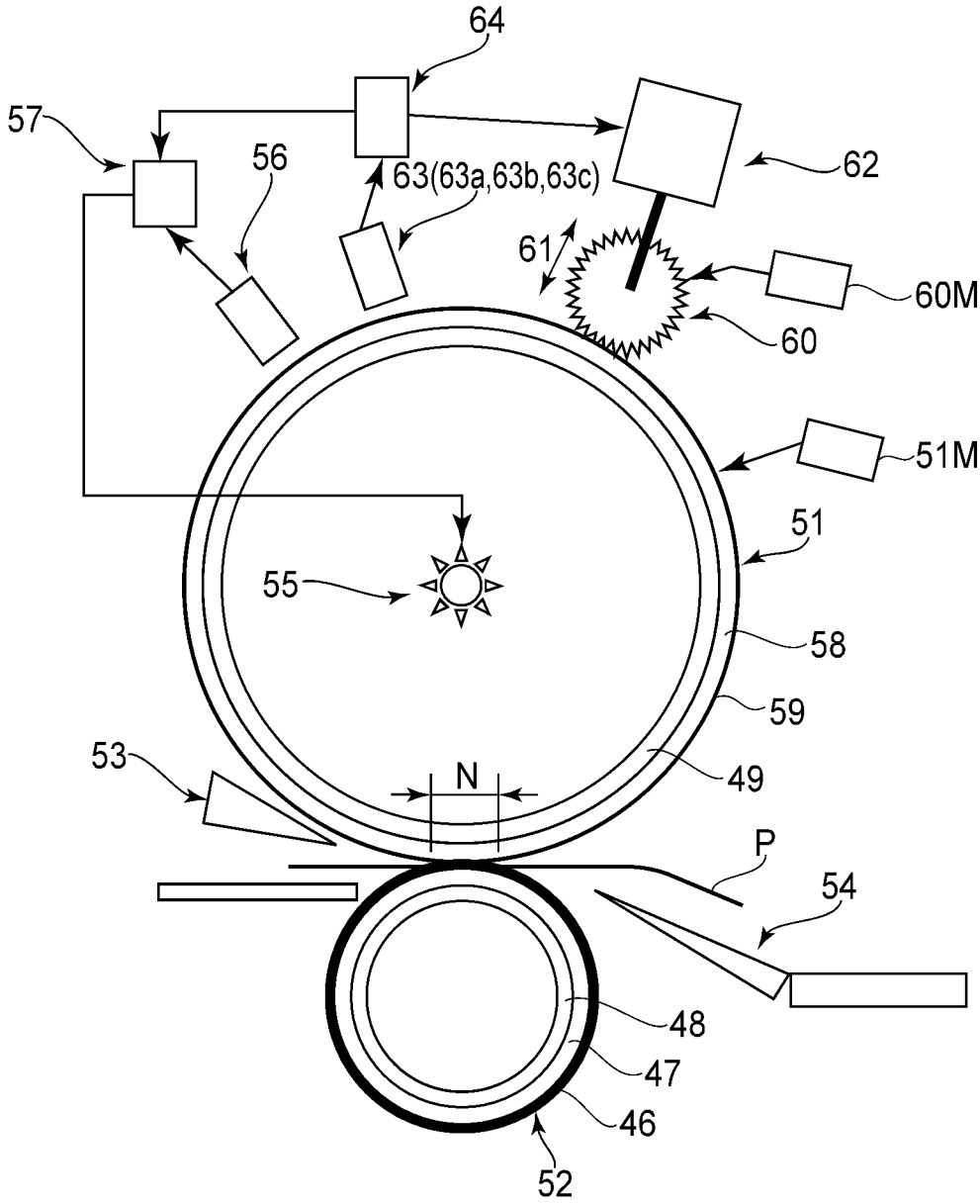
FIG. 2 is an illustration of a structure of a fixing device in a cross-section perpendicular to an axis.
Figure 3:
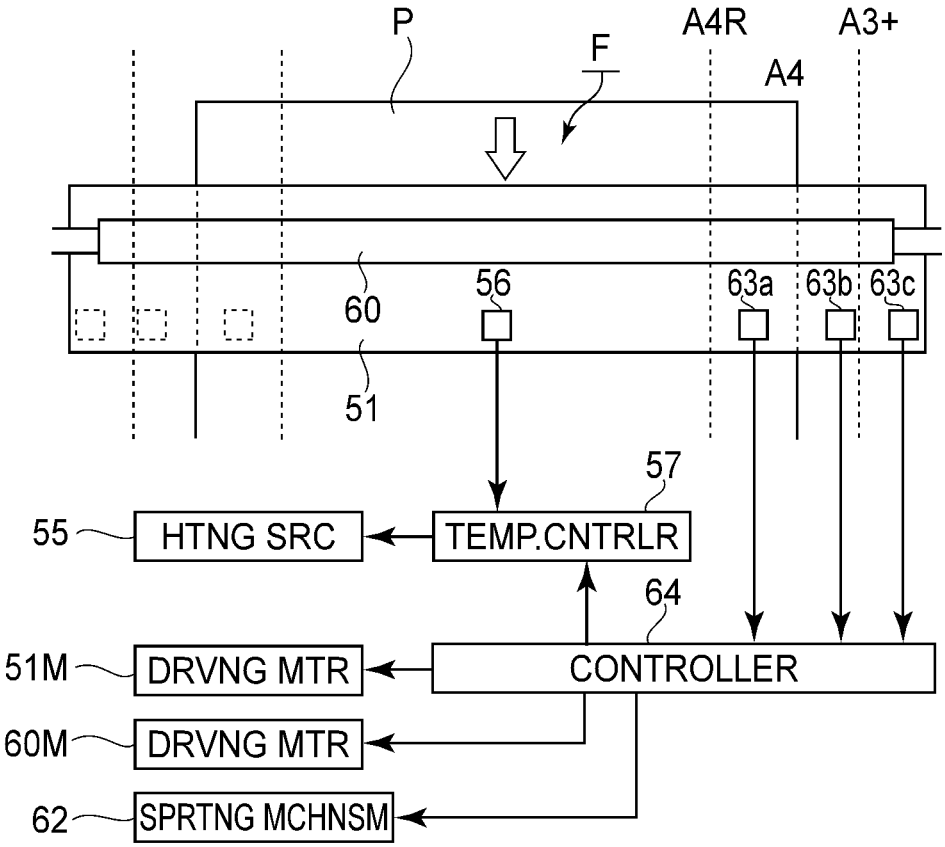
FIG. 3 is an illustration of a structure of the fixing device as seen from above.

FIG. 2 is an illustration of a structure of the fixing device in a cross-section perpendicular to an axis. FIG. 3 is an illustration of a structure of the fixing device as seen from above.

As shown in FIG. 2, a fixing roller 51, which is an example of the rotatable heating member, contacts the recording material P to heat the image, and a pressing roller 52, which is an example of the rotatable pressing member, contacts the fixing roller 51 to form a heating nip N for the recording material P. The fixing device F of a heating-roller type nip-conveys the recording material P, on which the toner images are electrostatically transferred, in the heating nip N, which is a contact portion between the rotating fixing roller 51 and the rotating pressing roller 52, and applies heat and pressure to the recording material P, so that the image is melt-fixed on the recording material P.

The fixing roller 51 is a roller, of 60 mm in outer diameter, to be rotationally driven by a driving motor 51M. The fixing roller 51 is prepared by disposing a 0.5-5 mm thick elastic layer 58 of silicone rubber or sponge or the like on pipe 49 of aluminum or the like, thus satisfactorily maintaining image quality (a fixing property, a gloss feeling and the like). The fixing roller 51 includes, as an outermost layer, a 20-100 μm thick parting layer 59 which is formed of polytetrafluoroethylene (PTFE), perfluoroalkoxy resin (PFA), or the like and which is coated on the elastic layer 58, thus ensuring a good parting property with respect to the melted toner.

The pressing roller 52 is a roller, of 30 mm in outer diameter, rotating in contact to the fixing roller 51. The pressing roller 52 is prepared, similarly to the fixing roller 51, by disposing a 2-10 μm thick elastic layer 47 of the silicone rubber or the sponge or the like on a pipe 48 of aluminum. As an outermost layer of the pressing roller 52, a silicone rubber parting layer 46, which has a good parting property with the toner and a good affinity with oil, is disposed.

The pressing roller 52 is urged toward the fixing roller 51 with a pressure load of 500 N to 1000 N in a total pressure by a pair of urging springs at both end portions thereof with respect to a rotational axis direction. The heating nip N to be formed between the pressing roller 52 and the fixing roller 51 is formed by compression deformation of the elastic layer 58 of the fixing roller 51 and the elastic layer 47 of the pressing roller 52 under pressure.

Sheet separation claws 53 are disposed at an exit side of the heating so as to be in contact to or close to the surface of the fixing roller 51 and forcedly separate the recording material P, which is not curvature-separated. at an exit of the heating nip N, from the fixing roller 51. A conveyance guide 54 guides the recording material P, on which the toner images are transferred, into the heating nip N.

A heating source 55 is a heat generating element, such as a halogen heater, and is disposed by penetrating through a central portion of the fixing roller 51, thus being energized from electrodes provided at both end portions, so that the heating source 55 infrared-heats the inner surface of the fixing roller 51.

A sheet passing portion, temperature detecting element (temperature sensor) 56 is a thermistor, a thermopile, or the like, and is disposed with a slight distance from the fixing roller 51, thus detecting a surface temperature of the fixing roller 51.

A temperature controller 57 adjusts electric power supplied to the heating source 55 so that the surface temperature of the fixing roller 51 is kept at a temperature-control target temperature set depending on the type of the recording material P by a controller 64. The temperature controller 57 detects the surface temperature of the fixing roller 51 on the basis of an output signal of the sheet-passing-portion, temperature-detecting element 56, and controls the heating source 55.

As shown in FIG. 3, at the center of the fixing roller 51 with respect to the rotational axis direction, the sheet-passing-portion, temperature-detecting element 56 is disposed. At positions remote from the center of the fixing roller 51 with respect to the rotational axis direction, corresponding to the A4R short-edge feeding size, the A4 long-edge feeding size, and the 13 inch (A3+) size of the recording material P, three non-sheet-passing-portion, temperature-detecting elements 63*a*, 63*b* and 63*c* are disposed. That is, the non-sheet-passing-portion, temperature-detecting elements 63*a*, 63*b* and 63*c* are disposed outside a range in which a minimum-sized recording material with respect to the widthwise direction of the fixing roller 51 passes. The non-sheet-passing-portion, temperature-detecting elements 63*a*, 63*b* and 63*c* are selected to correspond to the size of the recording material P to be subjected to the sheet passing and detect the surface temperature of the fixing roller 51 at an outside position of 20 mm from the edge of the recording material P with respect to a conveyance width direction.

The controller 64 effects image formation by increasing the image interval when the temperature detected by the non-sheet-passing-portion, temperature-detecting elements 63*a*, 63*b* and 63*c* exceeds 240° C., and lowers the electric power supplied to the heating source 55, thus suppressing the non-sheet-passing-portion temperature rise.

Further, in the case where, in addition to a first heating source increased in heat generation density at the central portion of the fixing roller with respect to the rotational axis direction, a second heating source, increased in heat generation density at both end portions of the fixing roller with respect to the rotational axis direction, is disposed in the fixing roller, the temperature control of the second heating source is effected on the basis of an output of the non-sheet-passing-portion, temperature-detecting element. When the temperature detected by the non-sheet-passing-portion, temperature-detecting element is increased, the electric power supplied to the second heating source is lowered, so that the non-sheet-passing-portion temperature rise is suppressed.

In either case, by ensuring the non-sheet-passing-portion temperature rise of the fixing roller to some extent, the temperature distribution of the fixing roller in the entire sheet passing region with respect to the rotational axis direction becomes flat, so that the uneven glossiness of the output image is eliminated. Further, by preventing the degree of the non-sheet-passing-portion temperature rise from being excessive, the effective roller diameter is stabilized, so that the occurrence frequency of a paper crease or recording-material jam can be lowered.

<Refreshing Roller>

As the fixing device, a fixing device of a heating-roller-pair type using the fixing roller and the pressing roller is used in general. In recent years, oil-less fixing for fixing an unfixed image consisting of a toner containing a parting agent has become popular. Corresponding to this, the fixing roller has a constitution in which an elastic layer of a silicone rubber or a fluorine-containing rubber is formed on a pipe of aluminum or iron, and thereon a parting layer consisting of a fluorine-containing resin tube or coating is formed as its surface layer. In the oil-less fixing type device, there is the advantage that an uneven glossiness, such as an oil stripe as in an oil fixing type device does not occur, so that with respect to a highly glossy recording material, such as resin-coated paper, a higher image quality than that in a conventional device can be achieved in combination with an improvement in toner.

However, with respect to the fixing roller provided with the parting layer at its surface, the surface property is gradually roughened by the trace of abrasion by the sheet passing and by deposition of contaminants, such as paper dust and an offset toner. Particularly, when a large amount of image formation is continuously effected on sheets of the recording material of the same size, as a result, a large number of sheets of the recording material are passed through a certain position of the fixing roller with respect to the rotational axis direction, so that the surface layer of the fixing roller is considerably roughened at a projected-paper edge passing portion as a boundary between a sheet passing portion and a non-sheet-passing portion.

This is because the projected-paper edge passing portion is a boundary where the recording material is to be nipped and, therefore a stepped portion is formed at the surface of the fixing roller and in a state in which the surface is elongated at the stepped portion surface, the edge of the recording material is repeatedly passed, and thus the trace of abrasion is accumulated. Further, paper dust, such as cellulose dust, is liable to be generated on the edge of the recording material, and therefore at inside and outside portions of the recording material edge, a minute recessed trace of abrasion is also formed on the pressing roller and the fixing roller in some cases.

Then, when the surface state is locally roughened at a part of the fixing roller with respect to the rotational axis direction, stripe-like uneven glossiness is generated on the fixed image. This is because an image portion fixed at a portion where the surface state is rough is lower in glossiness than that of an image portion fixed at a portion where the surface state is not rough.

Therefore, in the fixing device F, a refreshing roller 60 is contacted to the fixing roller 51 to rub the surface of the fixing roller 51 to be contacted to the unfixed toner image, so that the surface property of the fixing roller 51 at the respective portions (of the fixing roller 51) with respect to the rotational axis direction is uniformly restored to a predetermined initial state (surface property). The refreshing roller 60 is caused to rub the entire surface of the fixing roller 51 to prevent the surface property of the fixing roller 51 from deteriorating to a certain degree or more, so that a lowering in image quality of the output image is suppressed. Further, the time of exchange of the fixing roller 51 due to the deterioration of the surface property is postponed, so that an improvement in durability is realized.

The refreshing roller 60 which is an example of a rubbing device is disposed so as to be contactable to and separable from the fixing roller 51, and is contacted to the fixing roller 51 to rub the fixing roller 51. The fixing roller 51 has the parting layer 59 of the fluorine-containing resin on the surface of the elastic layer 58 of the rubber material, and the refreshing roller 60 is a rubbing member provided with abrasive grains fixed on its surface and is rotationally driven with a peripheral speed difference with respect to the surface of the fixing roller 51.

The refreshing roller 60 is formed by adhesively bonding the abrasive grains as an abrasive agent in a dense state onto the surface of a stainless pipe of 12 mm in outer diameter via an adhesive layer. As the abrasive grains as the abrasive agent, it is possible to use particles of aluminum oxide, aluminum oxide hydroxide, silicon oxide, cerium oxide, titanium oxide, zirconia, lithium silicate, silicon nitride, silicon carbide, iron oxide, chromium oxide, antimony oxide, diamond, and the like. It is also possible to use mixtures of a plurality of species of these abrasive grains, which are subjected to adhesive bonding treatment via the adhesive layer. In this embodiment, as the abrasive agent, alumina (aluminum oxide)-based material (which is also called "alundum" or "molundam") was used. The alumina-based material is the abrasive grain which is most widely used and has a sufficiently high hardness compared with the fixing roller 51 and a contour of the particle has an acute-angle shape. Therefore, the alumina-based material is excellent in machinability and is suitable as the abrasive agent.

The refreshing roller 60 is driven by a spacing mechanism 62 of a cam mechanism disposed at both end portions with respect to the rotational axis direction and is movable in a direction of an arrow 61, and the spacing mechanism 62 causes the refreshing roller 60 to be capable of being pressed against the fixing roller 51 with a predetermined penetration depth (entering amount) and be spaced from the fixing roller 51. When the refreshing roller 60 is pressed against the fixing roller 51 with the predetermined penetration depth, a rubbing nip is formed between the refreshing roller 60 and the fixing roller 51.

The refreshing roller 60 is driven by a driving motor 60M. The rotational direction of the refreshing roller 60 may be either of the same direction and an opposite direction with respect to the surface (movement direction) of the fixing roller 51. However, it is desirable that a difference in peripheral speed is provided between of the fixing roller 51 and the refreshing roller 60. The refreshing roller 60 is contacted to the fixing roller 51 with the peripheral speed difference to countlessly provide fine circumferential traces of abrasion on the surface of the fixing roller 51 in the entire region (sheet-passing portion (region), non-sheet-passing portion (region) and projected-paper edge passing portions) with respect to the rotational axis direction of the refreshing roller 60, so that the difference in surface state between projections and recesses can be eliminated. The trace of abrasion, by the passage of the projected-paper edge, left on the surface of the fixing roller 51 is superposed with fine traces of abrasion by the refreshing roller 60, so that the trace of abrasion by the passage of the projected-paper edge can be made invisible (unrecognizable).

Incidentally, the shape of the rubbing device is not limited to the roller shape. The rubbing device may also be a lapping taper used by being pulled out from a roller, a rotatable wire brush roller, a rubbing (abrasion) disk for effecting rubbing (abrasion) at its rotatable disk surface, a reciprocable plate file, and the like.

Incidentally, in this embodiment, a rubbing operation by the rubbing device may preferably be performed under the following condition. That is, the following relationship is satisfied.

$$7\times10^{-3}\leq(P/\pi H\tan\theta)\times(|V-v|/V)\leq68\times10^{-3},$$

where V represents a peripheral speed (mm/sec) of the rotatable heating member, v represents a peripheral speed (mm/sec) of the rubbing member, H represents minute hardness (GPa) of the rotatable heating member, θ represents half of apex angle (degrees) of the rubbing member and P represents a load (N) of the rubbing member on the rotatable heating member.

In addition, an average particle size of the abrasive grains may desirably be 5 μm or more and 20 μm or less. Further, by the rubbing operation by the rubbing member, the rotatable heating member may desirably have a surface roughness Rz of 0.5 μm or more and 2 μm or less and may desirably have a recessed portion, of 10 μm or less in width, formed by the abrasive agent in a ratio of 10 lines per more per 100 μm.

<Non-sheet-passing portion temperature rise>

When the recording material P is passed through the heating nip N of the fixing device F to fix the image, as described above, the temperature of the non-sheet-passing portion of the fixing roller 51 becomes higher than the temperature of the sheet passing portion. At the sheet passing portion, heat is absorbed by the recording material P in a room-temperature state but at the non-sheet-passing portion, the fixing roller 51 continuously contacts the high-temperature pressing roller 52 and thus heat is not so taken by the pressing roller 52. The temperature of the recording material P is lower than the temperature of the pressing roller 52 and therefore the heat is taken in a larger amount at the sheet passing portion than at the non-sheet-passing portion.

When the heat of the fixing roller 51 is absorbed by the recording material P, a lowering in temperature is detected by the sheet-passing-portion, temperature-detecting element 56. The temperature controller 57 increases, in order to compensate for the temperature lowering, the electric power supplied to the heating source 55, so that the temperature of the sheet passing portion is returned to a temperature-control target temperature. At the non-sheet-passing portion of the fixing roller 51, the amount of heat taken by the pressing roller 52 is smaller, even when the electric power supplied to the heating source 55 is increased, and therefore compared with the sheet passing portion of the fixing roller 51, the temperature of the non-sheet-passing portion of the fixing roller 51 becomes considerably high.

The fluorine-containing resin material (PFA, PTFE or the like) used for the parting layer 59 of the fixing roller 51 is lowered in mechanical strength with a higher temperature. Generally, when the material temperature exceeds 260° C., the lowering in mechanism strength becomes conspicuous. Further, when the high-temperature state continues for a long time, the lowering in mechanical strength becomes very large, so that the mechanical strength is not restored even when the fixing roller temperature is returned to a normal temperature.

Further, in the case where thick paper is passed (through the heating nip N), the stepped portion of the parting layer 59 formed at the projected-paper edge passing portion becomes large and therefore a shearing force acts on the parting layer 59, so that the trace of abrasion is liable to be generated on the surface of the fixing roller 51. In addition, when the thick paper is passed, the heat is absorbed by the thick paper in a large amount and therefore, the electric power supplied to the heating source 55 is increased, so that the degree of the non-sheet-passing-portion temperature rise becomes larger than that in the case where thin paper or plain paper is passed.

Further, in the case where a recording material, such as a post card, having a short length with respect to a conveyance direction is passed, pressure is concentrated at a corners of the short recording material, and therefore the shearing force acting on the parting layer 59 increases, so that a deep trace of abrasion is liable to be generated on the surface of the fixing roller 51. In addition, when the small-sized recording material is passed, the area in which the heat is absorbed by the recording material is decreased, and therefore the degree of the non-sheet-passing-portion temperature rise becomes larger than that in the case where a large-sized recording material is passed.

Therefore, in the case where the thick paper or the small-sized recording material is passed when the surface temperature of the fixing roller 51 is high, the deep trace of abrasion is liable to be generated at the projected-paper edge passing portion. When the thick paper or the small-sized recording material P is continuously passed, the shearing force at the projected-paper edge passing portion is large and the surface temperature of the fixing roller 51 becomes high, and therefore the deep trace of abrasion is liable to be generated at the projected-paper edge passing portion.

For this reason, in the case where the refreshing roller 60 rubs the surface of the fixing roller 51 for every image formation of a predetermined number of sheets, after continuous sheet passing of the thick paper or the small-sized recording material, the trace of abrasion of the parting layer 59 is deep, and therefore the trace of abrasion is left on the parting layer 59 under a normal rubbing (abrasion) condition, so that the uneven glossiness is left on the output image after the rubbing (abrasion) in some cases. Therefore, in order to sufficiently eliminate even the deep trace of abrasion generated by the continuous sheet passing of the thick paper or the small-sized recording material, an increase in rubbing pressure of the refreshing roller 60 and extension of a rubbing time were studied. Setting of a short (small) rubbing execution interval and a long rubbing time was studied in order to prevent the influence of the trace of abrasion on the image after the rubbing even in the case of the thick paper or the small-sized recording material.

However, in this case, although the uneven glossiness of the output image after the rubbing is eliminated, in the case where there is no continuous sheet passing of the thick paper or the small-sized recording material, the parting layer 59 of the fixing roller 51 is abraded more than necessary, so that the exchange lifetime of the fixing roller 51 becomes short. By effecting the rubbing for a long time, the apparatus suffers more down time than necessary, so that productivity of the image forming apparatus 100 is lowered.

In the case where the refreshing condition is set correspondingly to the thick paper or the small-sized plain paper for which a level of the trace of abrasion of the fixing roller 51 at the projected-paper edge passing portion is increased, during the sheet passing of the thin paper or the large-sized plain paper, the refreshing is executed more than necessary, and thus the exchange lifetime of the fixing roller 51 is shortened. In addition, the fixing roller waits for the end of the refreshing and therefore an unnecessary stand-by time is generated.

In the case where the refreshing condition is set to correspond to the thin paper or the large-sized plain paper for which the level of the trace of abrasion of the fixing roller 51 at the projected-paper edge passing portion is decreased, during the sheet passing of the thick paper or the small-sized plain paper, the surface state of the fixing roller 51 at the projected-paper edge passing portion cannot be restored by the refreshing. As a result, the uneven glossiness is left on the output image.

Therefore, a method was studied in which a user is caused to register (designate) the basis weight and the size of the paper to be used, and on the basis of the size, the basis weight, and the number of sheets of the recording material subjected to the sheet passing, not only the rubbing execution interval, but also the rubbing time are variably set by the controller. In some image forming apparatus in recent years, in which the user registers the basis weight, the type (coated paper, non-coated paper, embossed paper, roughened paper, or the like), and the size of the recording material to be passed and then the image forming apparatus selects a transfer condition and a fixing condition corresponding to the associated recording material P. When this system is used, from the size, the basis weight and the number of sheets of the recording material subjected to the sheet passing, the temperature and shearing force of the fixing roller 51 at the projected-paper edge passing portion are discriminated, and thus the state of the trace of abrasion at the projected-paper edge passing portion is discriminated, so that the timing and condition of the refreshing can be changed.

A method was studied in which the controller 64 calculates, on the basis of such registered information, the non-sheet-passing-portion temperature rise of the fixing roller 51 and a change in shearing force by the temperature rise to estimate a surface roughening state of the parting layer 59, and then adjusts the rubbing condition. However, in the case where the user first erroneously make the registration or erroneously mounts a recording material cassette, basically erroneous control is automatically executed, so that an image with remarkable uneven glossiness can be outputted. In the case where the user erroneously make the registration, the controller 64 makes an erroneous discrimination, and therefore the exchange lifetime of the fixing roller 51 is shortened or the uneven glossiness of the output image is generated.

Further, even when the registration is not erroneously made and the recording material is the same, the amount of heat absorbed by the recording material largely varies depending on the amount of moisture absorption of the recording material at that time. When several sheets of the recording material having a large amount of moisture absorption are continuously passed, the electric power supplied to the heating source 55 is not changed from its maximum and thus the degree of the non-sheet-passing-portion temperature rise becomes large, so that roughening of the parting layer 59 abruptly proceeds in some cases.

Further, in the case of a mixed job in which the image formation is effected on a plurality of types of recording materials different in type or paper size, not only is the estimation calculation complicated, but also the estimation result and the actual roughening state of the parting layer 59 do not readily coincide with each other.

In the following embodiments, by simple control on the basis of an output of the already-provided, non-sheet-passing-portion, temperature-detecting element, the registration of the recording material by the user is made unnecessary, so that indefinite factors in the refreshing control are reduced. On the basis of the detection temperature of the non-sheet-passing-portion, temperature-detecting element, by changing the rubbing condition, a long lifetime of the fixing roller 51 is ensured, while eliminating the influence on the output image.

<Embodiment 1>

Figure 4:
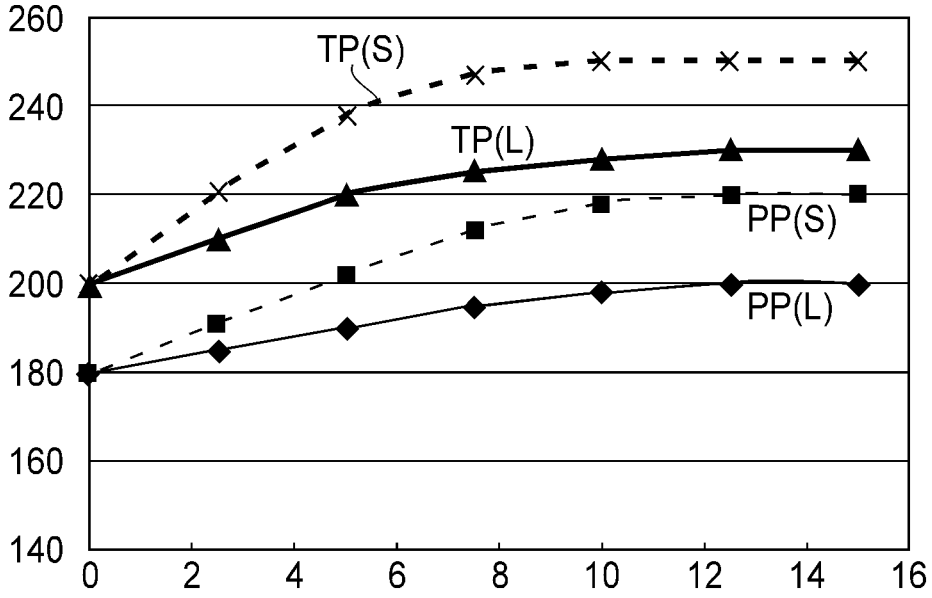
FIG. 4 is a graph for illustrating temperature rise at a non-sheet-passing portion with continuous image formation.
Figure 5:
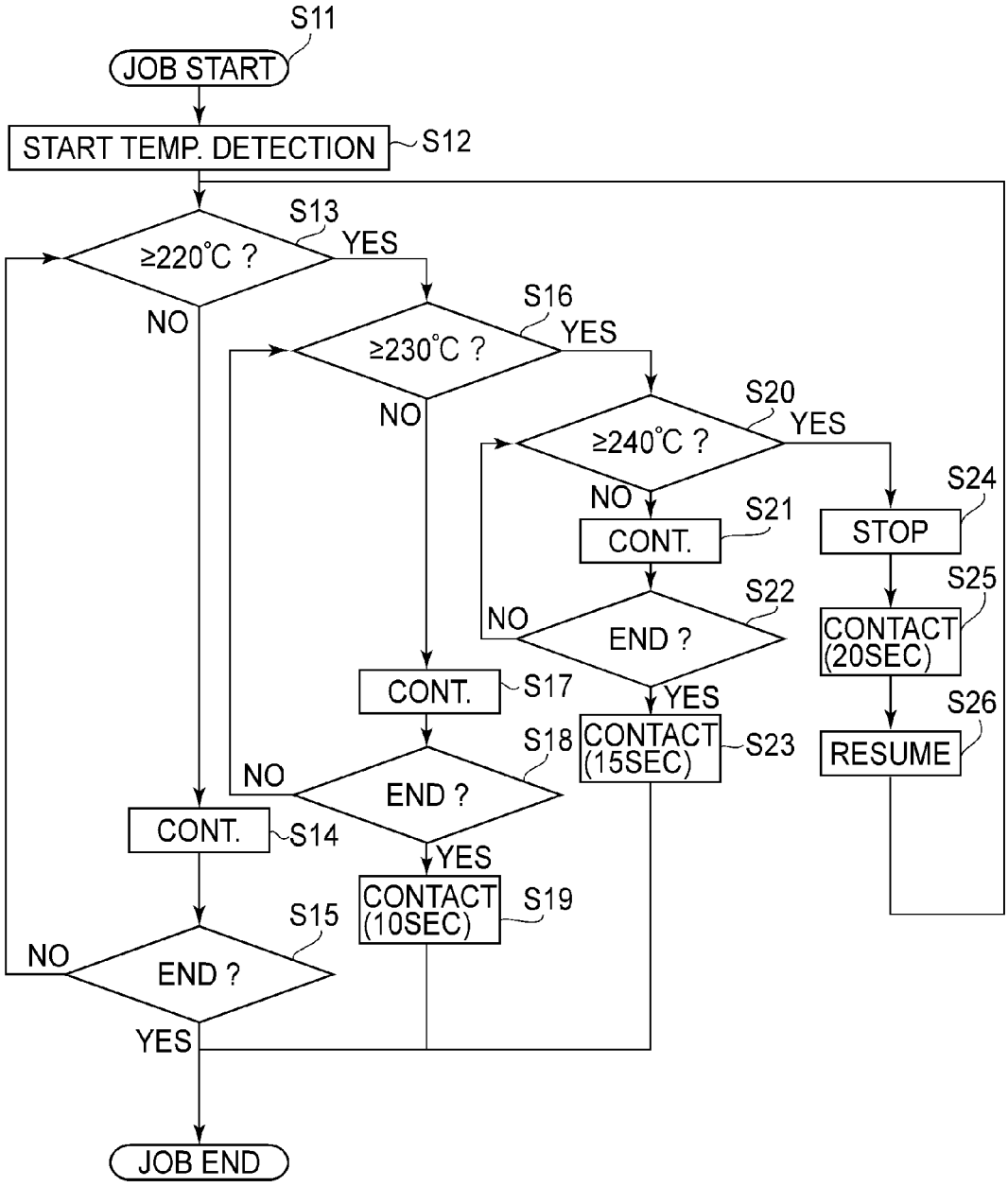
FIG. 5 is a flow chart of refreshing control in Embodiment 1.

FIG. 4 is a graph for illustrating the non-sheet-passing-portion temperature rise with continuous image formation. FIG. 5 is a flow chart of refreshing control in Embodiment 1. As shown in FIG. 4, first, as a preliminary experiment, the non-sheet-passing-portion temperature rise with respect to each of various recording materials was measured. The non-sheet-passing-portion temperature rise was measured with respect to each of A4-sized plain paper (basis weight: 81.4 $g/m_2$) in long-edge feeding (plain paper: large ("PP(L)")) and in short-edge feeding (plain paper: small ("PP(S)") and A4-sized thick paper (basis weight: 200 $g/m_2$) in long-edge feeding (thick paper: large ("TP(L)") and in short-edge feeding (thick paper: small ("TP(S)"). The ordinate represents the surface temperature of the fixing roller 51, and the abscissa represents an elapsed time from start of continuous image formation. As shown in FIG. 3, with respect to each of the recording materials, continuous image formation is executed, and progression of a temperature detected by the non-sheet-passing-portion, temperature-detecting element 63*c* disposed outside a maximum sheet passing width (region) was recorded.

As indicated by a (thin) solid line, in the case of continuous sheet passing of the plain paper (large), the plain paper is temperature-controlled at 180° C. and therefore the sheet passing portion of the fixing roller 51 is temperature-controlled at 180° C. At the non-sheet-passing portion of the fixing roller 51, heat is not absorbed by the recording material P and therefore after the image formation is started, the fixing roller temperature is gradually increased up to 200° C.

As indicated by a (thin) broken line, in the case of the continuous sheet passing of the plain paper (small), the plain paper is temperature-controlled at 180° C. and therefore the sheet passing portion of the fixing roller 51 is temperature-controlled at 180° C. In the case of the small-sized paper, the non-sheet-passing portion of the fixing roller 51 is wider than that in the case of the large-sized paper and therefore the degree of the non-sheet-passing-portion temperature rise is large, so that the fixing roller temperature is increased up to 220° C.

As indicated by a thick solid line, in the case of the continuous sheet passing of the thick paper (large), with respect to the thick paper, heat is absorbed by the recording material in a large amount, and therefore in order to maintain a toner fixing strength, the temperature control is switched to 200° C.—temperature control. Further, the thick paper has a heat quantity absorbed at the sheet passing portion in a larger amount than that of the plain paper. Therefore, the heat quantity supplied for controlling the temperature at the sheet passing portion to a predetermined temperature is also larger, and as a result, the degree of the non-sheet-passing-portion temperature rise is larger than that for the plain paper, so that the temperature of the fixing roller 51 at the non-sheet-passing portion is increased up to 230° C.

As indicated by a thick broken line, in the case of the continuous sheet passing of the thick paper (small), the recording material has a small size in addition to the thick paper, and therefore compared with other cases, the degree of the non-sheet-passing-portion temperature rise is large, so that the fixing roller temperature is increased up to 250° C.

As shown in FIG. 5 with reference to FIG. 2, in Embodiment 1, the controller 64, which is an example of a control means, decreases the rubbing (abrasion) amount of the fixing roller 51 by the refreshing roller 60 with a lower surface temperature of the fixing roller 51 in a region, where the recording material edge passes, with respect to the rotational axis direction of the fixing roller 51. Specifically, the controller 64 executes the rubbing of the refreshing roller 60 on the fixing roller 51 when the surface temperature detected by the non-sheet-passing-portion, temperature-detecting element 63 exceeds a predetermined temperature, and with a lower surface temperature, decreases the rubbing amount of the fixing roller 51 by the refreshing roller 60.

The non-sheet-passing-portion, temperature-detecting element 63, which is an example of a temperature detecting means, is capable of detecting the surface temperature of the fixing roller 51 at an outside position, where the recording material passes, with respect to the rotational axis direction of the fixing roller 51. The non-sheet-passing portion, temperature-detecting element 63*c* detects the temperature of the non-sheet-passing portion outside a normal sheet width (region) with respect to the rotational axis direction of the fixing roller 51. The controller 64 controls contact/separation and rotation of the refreshing roller 60 on the basis of the detection temperature of the non-sheet-passing-portion, temperature-detecting element 63*c*, thus changing the rubbing condition in the refreshing control.

The controller 64 starts, when a job is started (S11), temperature detection of the non-sheet-passing portion (of the fixing roller 51) by the non-sheet-passing-portion temperature-detecting element 63*c* (S12). During the continuous image formation, the controller 64 continues, in the case where the detection temperature of the non-sheet-passing-portion, temperature-detecting element 63*c* is less than 220° C. (NO of S13), the image formation (sheet passing) without performing the refreshing (S14). Then, when the image formation is ended (YES Of S15), the job is ended.

As shown in FIG. 4, even when the plain paper and the large-sized recording material of the thin paper are passed, the end portion temperature is increased up to only about 200° C., and therefore the refreshing is not effected. In the case of the plain paper and the large-sized recording material of the thin position, even when a large-volume sheet passing occurs, the recording material P is thin and the size is large, and therefore concentration of pressure is not generated, so that a large shearing force does not act. Further, the temperature of the fixing roller 51 at the projected-paper edge passing portion does not become high, and therefore the mechanical strength of the parting layer 59 is high and the trace of abrasion is slight, so that an image defect is not generated, and therefore there is no need to perform the refreshing.

Even the recording material, such as the thick paper or the small-sized recording material, on which a large shearing force acts, in the case where small-volume sheet passing occurs, the temperature of the fixing roller 51 at the projected-paper edge passing portion is low, and therefore the mechanical strength of the parting layer 59 is high, and the number of sheets subjected to the sheet passing is small, and therefore the number of times of the action of the shearing force is also small. For this reason, a level of the trace of abrasion of the parting layer 59 is slight, so that there is no need to perform the refreshing.

During the continuous image formation, the controller 64 continues, also in the case where the detection temperature of the non-sheet-passing-portion, temperature-detecting element 63*c* reaches 220° C. (YES of S13) and then is kept in a state of less than 230° C. (NO of S16), the image formation (sheet passing) without performing the refreshing (S17). Then, when the image formation is ended (YES of S18), the refreshing roller 60 is contacted to the fixing roller 51 to execute the refreshing for 10 sec (S19) and then the job is ended.

As shown in FIG. 4, when the continuous sheet passing of the thick paper or the small-sized plain paper is continued, the detection temperature of the non-sheet-passing-portion, temperature-detecting element 63*c* exceeds 220° C. When the thick paper or the small-sized recording material is continuously passed, the non-sheet-passing-portion temperature becomes high in a state in which the large shearing force acts, so that roughening of the fixing roller 51 proceeds. The mechanical strength of the parting layer 59 becomes low, so that the trace of abrasion of the fixing roller 51 at the projected-paper edge passing portion is increased and thus the refreshing is required. However, the trace of abrasion of the parting layer 59 is generated outside an image region and therefore the uneven glossiness of the output image is not generated so long as the sheet passing of the same-sized recording material is continued. It can be said that also the mechanical strength of the parting layer 59 is within a tolerable range and therefore the refreshing is effected for 10 sec after the end of the sheet passing. Separately from the flow chart of FIG. 5, in the case where the recording material size is switched from small to large in midstream of the job, the uneven glossiness is generated on the large-sized recording material, and therefore the refreshing is effected at the time of switching.

During the continuous image formation, the controller 64 continues, also in the case where the detection temperature of the non-sheet-passing-portion, temperature-detecting element 63*c* reaches 220° C. (YES of S16) and then is kept in a state of less than 240° C. (NO of S20), the image formation (sheet passing) without performing the refreshing (S21). Then, when the image formation is ended (YES of S22), the refreshing roller 60 is contacted to the fixing roller 51 to execute the refreshing for 15 sec (S23) and then the job is ended. The controller 64 discriminates that the degree of the roughening of the fixing roller 51 at the projected-paper edge passing portion is larger than that in the case of less than 230° C., and makes the refreshing time long. As described above, so long as the sheet passing of the same-sized recording material is continued, the uneven glossiness of the output image is not generated and therefore the refreshing is not performed, but in the case where the recording material size is switched from small to large in the midstream of the job, the refreshing is performed.

During the continuous image formation, the controller 64 interrupts, when the detection temperature of the non-sheet-passing-portion, temperature-detecting element 63*c* reaches 240° C. (YES of S20), the image formation (sheet passing) (S24) and then executes the refreshing for 20 sec (S25). When the refreshing is ended, the sheet passing is resumed to continue the image formation (S26).

The controller 64 discriminates, in the case where the non-sheet-passing-portion temperature reaches 240° C., that restoration of the mechanical strength of the fixing roller 51 at the projected-paper edge passing portion should take precedence over the productivity. This is because when the depth the trace of abrasion of the fixing roller 51 at the projected-paper edge passing portion becomes excessively large, a difference in depth between the trace of abrasion of the fixing roller 51 and the minute trace of abrasion left by the refreshing is provided, and thus the resultant trace of abrasion at the projected-paper edge passing portion becomes conspicuous at the surface of the fixed image. Further, when the trace of abrasion is left on the fixing roller 51 further and the sheet passing is continued, the temperature of the parting layer 59 of the fixing roller 51 approaches 260° C., which is design temperature of the material for the parting layer 59 (the fixing roller 51), and therefore the mechanical strength of the parting layer 59 is impaired, and thus the possibility is increased that the trace of abrasion, which is difficult to be eliminated by the refreshing, is generated.

The controller 64 interrupts the sheet passing and cools down only the non-sheet-passing portion while maintaining the temperature-control state of the sheet passing portion of the fixing roller 51, so that the mechanical strength of the parting layer 59 is restored. The down time by the cool down is effectively used to execute the refreshing, so that the trace of abrasion generated on the fixing roller 51 is eliminated. The controller 64 interrupts the sheet passing and performs the refreshing for 20 sec. In the case where the non-sheet-passing portion temperature is increased to 240° C. or more, the degree of the roughening of the parting layer 59 is larger than that in the case where the non-sheet-passing-portion temperature is increased to 230° C., and therefore the refreshing time is set at a larger value. Further, by interrupting the sheet passing, the temperature of the parting layer 59 is lowered, and therefore in the resumed sheet passing, the depth of the trace of abrasion of the fixing roller 51 at the projected-paper edge passing portion is shallow.

In the case where the number of sheets of the thick paper or the small-sized recording material subjected to the sheet passing is large, when the number of times of the action of the shearing force is increased, the roughening of the fixing roller 51 at the projected-paper edge passing portion proceeds and the non-sheet-passing-portion temperature is further increased. In the case of the recording material having an extremely small size, the roughening of the fixing roller 51 at the projected-paper edge passing portion further proceeds due to further pressure concentration and enlargement of the non-sheet-passing portion, and the non-sheet-passing-portion temperature is further increased. Also in the case of the thick paper having an extremely large size, the shearing force acting on the parting layer 59 becomes large and in addition, the heat quantity taken from the sheet passing portion becomes large, so that the roughening of the fixing roller 51 at the projected-paper edge passing portion further proceeds, and also the non-sheet-passing portion temperature is further increased.

Specifically, the image forming apparatus has a productivity such that the A4-sized recording material P is outputted at a rate of 100 sheets/min. In the case of the refreshing control such that the refreshing for 20 sec is performed for every image formation of 250 sheets while disregarding the type and size of the recording material, in order to output 5000 sheets of the A4-sized recording material, it takes 50 minutes for the sheet passing and 6 minutes and 40 seconds for the refreshing. Further, also in the case of the thin paper and the plain paper, which are originally not required to be subjected to the refreshing, it takes 50 minutes for the sheet passing and 6 minutes and 40 seconds for the refreshing.

Further, the parting layer 59 of the fixing roller 51 in the image forming apparatus 100 is a 70 μm-thick PFA tube and is abraded by 0.1 μm every sheet passing of 1000 sheets of the A4-sized plain paper. Further, when the refreshing is performed for 20 sec, the parting layer 59 is abraded by 0.01 μm. Therefore, in the case where the sheets of the A4-sized plain paper are passed and the refreshing is performed for 20 sec every 250 sheets, the parting layer 59 is abraded by 0.14 μm per 1000 sheets. For this reason, the parting layer 59 disappears by the sheet passing of 500,000 sheets and the fixing roller 51 reaches the end of its exchange lifetime.

On the other hand, according to the refreshing control in Embodiment 1, the refreshing is not performed in the case of the thin paper and the large-sized recording material (including A4) of the plain paper and therefore the sheet passing is completed in 50 minutes and the refreshing for 6 minutes and 40 seconds is not needed, so that a processing time can be reduced by 12% in total. Further, the refreshing is not performed for the thin paper and the large-sized recording material of the plain paper, and therefore the abrasion amount is 0.1 μm per 1000 sheets of the A4-sized plain paper, so that estimation such that the parting layer 59 disappears by the sheet passing of 700,000 sheets is made, and thus the exchange lifetime of the fixing roller 51 is prolonged by 40%.

In this embodiment, by changing the refreshing condition depending on the detection temperature of the non-sheet-passing-portion, temperature-detecting element 63*c*, it is possible to prevent generation of a waiting time more than necessary and shortening of the lifetime of the fixing roller 51 by performing the refreshing of the parting layer 59 more than necessary.

In this embodiment, as described above, by the detection temperature of the non-sheet-passing-portion, temperature-detecting element 63*c*, the type of plain paper/thick paper of the recording material, the heat quantity taken from the fixing roller 51 by the thick paper, and the recording material size are indirectly discriminated. In other words, the mechanical strength of the fixing roller 51 at the projected-paper edge passing portion is estimated without discriminating the type of plain paper/thick paper of the recording material, the heat quantity taken from the fixing roller 51 by the thick paper, and the recording material size, so that the roughening state of the parting layer 59 is discriminated. By detecting the temperature of the fixing roller 51 at the non-sheet-passing portion, the state of the trace of abrasion of the fixing roller 51 at the projected-paper edge passing portion is discriminated.

In this embodiment, on the basis of the detection temperature of the fixing roller 51 at the non-sheet-passing portion, the refreshing condition is changed, and therefore even when the user makes erroneous registration during the registration, it is possible to prevent the shortening of the lifetime of the fixing roller and the occurrence of the first defect which are caused by erroneous discrimination. In this embodiment, the refreshing condition is changed depending on the non-sheet-passing-portion temperature of the fixing roller 51, but depending on the non-sheet-passing-portion temperature of the fixing roller 51, it is also possible to change the contact pressure of the refreshing roller 60 or the peripheral speed difference between the refreshing roller 60 and the fixing roller 51.

<Embodiment 2>

Figure 6:
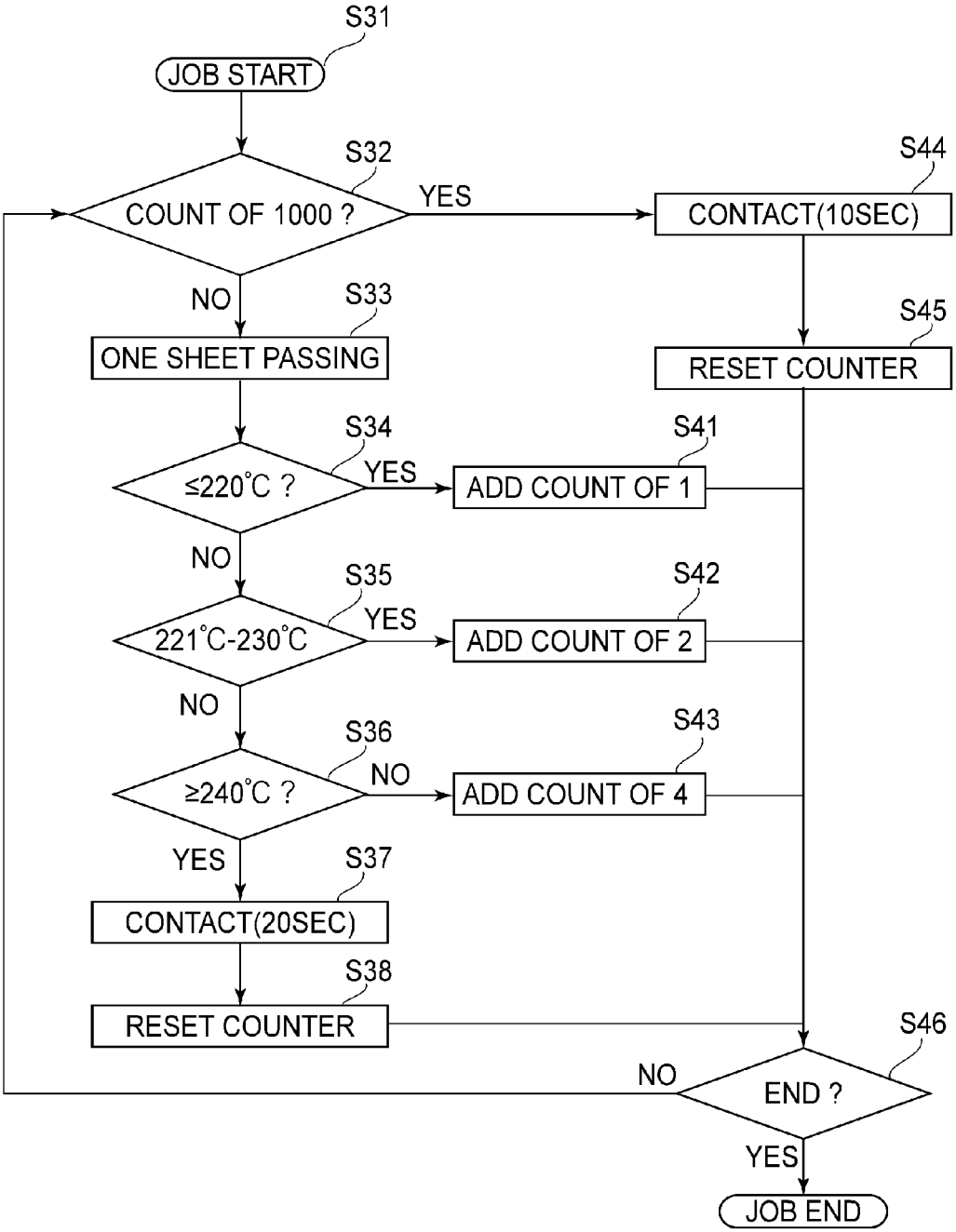
FIG. 6 is a flow chart of refreshing control in Embodiment 2.

FIG. 6 is a flow chart of refreshing control in Embodiment 2. As shown in FIG. 4, the A4-sized recording material of the plain paper with a high frequency of use provides a shearing force, which is not so large, acting on the parting layer 59 of the fixing roller 51, and also the surface temperature of the fixing roller 51 at the projected-paper edge passing portion is not so increased, and therefore a serious trace of abrasion is not generated on the parting layer 59 in general. However, depending on the type of the plain paper, when a very large volume continuous sheet passing occurs, the trace of abrasion of the fixing roller 51 is generated at the projected-paper edge passing portion, so that a stripe uneven glossiness is generated on the output image in some cases. Therefore, in Embodiment 2, even for the A4-sized recording material of the plain paper or the recording material of the thin paper, the refreshing is executed at a frequency of at least one time for every sheet passing of 1000 sheets. Further, the frequency of the refreshing to be executed is set at a higher value with a larger degree of the increase in surface temperature of the fixing roller 51 at the non-sheet-passing portion.

As shown in FIG. 6 with reference to FIG. 2, the controller 64 counts, when the job is started (S31), the count of a totalizing means (counter) for every sheet passing of one sheet (S33) at a rate corresponding to the detection temperature of the non-sheet-passing-portion, temperature-detecting element 63*c* (S41 to S43).

The controller 64 interrupts, when the count of the totalizing means reaches 1000 (YES of S32), the sheet passing and then causes the refreshing roller 60 to contact the fixing roller 51 to perform the refreshing for 10 sec (S44). The controller 64 resets the totalizing means after the refreshing is performed, so that the count is returned to zero (S45).

The controller 64 executes the refreshing at the frequency of one time per 1000 sheets with respect to the A4-sized recording material of the plain paper or the recording material of the thin paper. However, when the refreshing is executed at the same frequency also during the continuous sheet passing of the thick paper or the small-sized recording material, the trace of abrasion is deep and therefore the surface property (state) of the fixing roller 51 at the projected-paper edge passing portion cannot be sufficiently restored by the refreshing. This is because the difference in depth is provided between the trace of abrasion formed on the fixing roller 51 at the projected-paper edge passing portion and the minute trace of abrasion provided by the refreshing, and thus the uneven glossiness is left on the output image.

Therefore, the controller 64 counts, for every sheet passing of one sheet (S33), the count of the totalizing means (counter) at a rate corresponding to the detection temperature of the non-sheet-passing-portion, temperature-detecting element 63*c* (S41 to S43).

The controller 64 continues the image formation (sheet passing) (S32, S33) until the number of sheets reaches a set number of sheets subjected to the image formation (sheet passing) (NO of S46). Then, when the image formation (sheet passing) of the set number of sheets is ended (YES of S46), the job is ended.

The controller 64, for every sheet passing of one sheet (S33), in the case where the detection temperature of the non-sheet-passing-portion, temperature-detecting element 63*c* is 220° C. or less (YES of S34), adds the count of 1 to the totalizing means (S41).

As shown in FIG. 4, in the case where only the thin paper or the large-sized recording material is subjected to the sheet passing, the detection temperature of the non-sheet-passing-portion, temperature-detecting element 63*c* does not reach 220° C. Therefore, the controller 64 increments the totalizing means by the count of 1 and then performs the refreshing for 10 sec one time every 1000 sheets for which the count reaches 1000 (S44).

The controller 64, for every sheet passing of one sheet (S33), in the case where the detection temperature of the non-sheet-passing-portion, temperature-detecting element 63*c* is 221-230° C. (YES of S35), adds the count of 2 to the totalizing means in order to shorten a sheet passing interval in which the refreshing is performed (S42).

As shown in FIG. 4, in the case where the thick paper or the small-sized recording material is subjected to the continuous sheet passing, the detection temperature of the non-sheet-passing-portion, temperature-detecting element 63*c* is gradually increased and exceeds 220° C. There is a tendency that the trace of abrasion of the fixing roller 51 becomes deep by the increase in temperature at the non-sheet-passing portion and therefore, the controller 64 performs the refreshing for 10 sec one time every 500 sheets (S44).

The controller 64, for every sheet passing of one sheet (S33), in the case where the detection temperature of the non-sheet-passing-portion, temperature-detecting element 63*c* is 231-239° C. (NO of S36), adds the count of 4 to the totalizing means in order to further shorten a sheet passing interval in which the refreshing is performed (S43).

When the sheet passing of the thick paper or the small-sized recording material is further continued, the detection temperature of the non-sheet-passing-portion, temperature-detecting element 63*c* is further increased and exceeds 230° C. There is a tendency that the trace of abrasion of the fixing roller 51 becomes further deep by the increase in temperature at the non-sheet-passing portion and therefore, the controller 64 performs the refreshing for 10 sec one time every 250 sheets (S44).

The controller 64 immediately interrupts, in the case where the detection temperature of the non-sheet-passing-portion, temperature-detecting element 63*c* exceeds 240° C. (YES of S36), the sheet passing and then performs the refreshing for 20 sec (S37). This is because when the sheet passing is continued as it is, the trace of abrasion of the fixing roller 51 becomes excessively deep and thus the difference in depth between the trace of abrasion of the fixing roller 51 and the minute trace of abrasion provided by the refreshing roller 60 is generated and adversely affects the output image. Also in this case, when the refreshing is performed (S37), then the count of the totalizing means is reset to zero (S38).

In Embodiment 2, even when the sheets of the recording material for which the detection temperature of the non-sheet-passing-portion, temperature-detecting element 63*c* is not increased are subjected to the sheet passing in large volume, the refreshing is performed at the frequency of at least one time per 1000 sheets, and therefore it is possible to prevent the trace of abrasion of the fixing roller 51 at the projected-paper edge passing portion. Even when the sheets of the recording material, for which the detection temperature of the non-sheet-passing-portion, temperature-detecting element 63*c* is not increased, are subjected to sheet passing in large volume, the refreshing is performed at a predetermined interval, so that it is possible to prevent the uneven glossiness of the output image caused by the trace of abrasion of the fixing roller 51 at the projected-paper edge passing portion. However, when the status of the apparatus is such that the detection temperature of the non-sheet-passing-portion temperature-detecting element 63*c* is increased, and thus the mechanical strength of the parting layer 59 is lowered, the execution frequency of the refreshing is increased and therefore a serious trace of abrasion of the fixing roller 51 at the projected-paper edge passing portion is prevented from being generated.

In this embodiment, in the case of the sheet passing of the thick paper or the small-sized recording material, the refreshing interval is set at a small value and the refreshing time is set at a large value, and therefore in general, the refreshing for 10 sec is executed every 1000 sheets correspondingly to the A4-sized plain paper with a high frequency of use. In the case of the thin paper or the large-sized recording material (including A4) of the plain paper, the detection temperature of the non-sheet-passing-portion, temperature-detecting element 63*c* is only increased up to about 200° C., and therefore the refreshing is performed only every 1000 sheets.

In this embodiment, the thick paper or the small-sized recording material is discriminated from the detection temperature of the non-sheet-passing-portion, temperature-detecting element 63*c*, and the refreshing interval is made long and the refreshing time is made short, and therefore with respect to the plain paper or the thin paper, it is possible to set the refreshing interval at a large value and set the refreshing time at a small value. For this reason, the time required for image output of the job can be shortened and the exchange lifetime of the fixing roller 51 can be prolonged.

Specifically as described above, in the case where the refreshing for 20 sec is performed one time for every sheet passing of 250 sheets, irrespective of the type and size of the recording material, in order to output 5000 sheets of the A4-sized plain paper, it takes 50 minutes for the sheet passing and 6 minutes and 40 seconds for the refreshing. Further, the parting layer 59 of the fixing roller 51 is a 70 μm-thick PFA tube and is abraded by 0.1 μm every sheet passing of 1000 sheets of the A4-sized plain paper. Further, when the refreshing is performed for 10 sec, the parting layer 59 is abraded by 0.005 μm. For this reason, in the case of setting in which the refreshing is performed for 20 sec every 250 sheets, when the A4-sized plain paper is passed, the parting layer 59 is abraded by 0.14 μm per 1000 sheets, and therefore, the parting layer 59 disappears by the sheet passing of 500,000 sheets and the fixing roller 51 reaches the end of its exchange lifetime.

On the other hand, in the refreshing control in Embodiment 2, in order to output 5000 sheets of the A4-sized plain paper, the control can be ended in 50 minutes for the sheet passing and 50 seconds for the refreshing, so that the time for the control can be shortened by 10%. Further, in the case of the thin paper or the large-sized recording material (including A4) of the plain paper, the refreshing is performed only one time per 1000 sheets and therefore when the A4-sized plain paper is passed, the abrasion amount is 0.105 μm per 1000 sheets. For this reason, the parting layer 59 disappears at the time of 666,667 sheets, so that the exchange lifetime of the fixing roller 51 is prolonged by 33%.

<Embodiment 3>

As shown in FIG. 3, the fixing device F includes three non-sheet-passing portion, temperature-detecting elements 63 (63*a*, 63*b*, 63*c*) depending on the sizes of the recording materials. The reason why the non-sheet-passing-portion temperature detecting element 63*b* is used for the control in Embodiments 1 and 2 is that a temperature fluctuation with passing/non-passing of the recording material is large in the case of the inside sheet-passing-portion, temperature detecting element 63*a* and thus the temperature at the projected-paper edge passing portion cannot be stably estimated. Further, the reason is also that the outermost non-sheet-passing-portion, temperature-detecting element 63*c* is excessively far from the projected-paper edge passing portion of the fixing roller 51 and thus the temperature at the projected-paper edge passing portion cannot be stably estimated.

However, with respect to the non-sheet-passing-portion, temperature-detecting elements 63, the refreshing control in Embodiments 1 and 2 may also be executed by switching the non-sheet-passing-portion, temperature-detecting elements 63*a*, 63*b* and 63*c* depending on the recording material size.

Further, the non-sheet-passing-portion, temperature-detecting element 63 may also be disposed movably in the rotational axis direction of the fixing roller 51 and is positioned at a non-sheet-passing-portion position depending on the recording material size, and then the refreshing control may be executed. However, also in this case, in order to measure the temperature close to the temperature at the projected-paper edge passing portion, the non-sheet-passing-portion, temperature-detecting element 63 may desirably be positioned at a position close to the projected-paper edge passing portion. However, with a distance closer to the sheet passing portion, the temperature fluctuation by the passing/non-passing of the recording material becomes larger, so that the temperature at the projected-paper edge passing portion cannot be stably estimated. Therefore, the non-sheet-passing portion, temperature-detecting element 63 may desirably be positioned at a position spaced from the sheet passing position to some extent.

In Embodiments 1 and 2, the level of the trace of abrasion of the fixing roller 51 at the projected-paper edge passing portion was discriminated by the detection temperature of the non-sheet-passing-portion, temperature-detecting element 63 and then the refreshing condition was changed. Depending on the estimated temperature of the fixing roller 51 at the projected-paper edge passing portion, the contact time of the refreshing roller 60 and the frequency of the refreshing were changed.

However, a refreshing condition other than these conditions may also be changed. Specifically, a contact pressure applied from the refreshing roller 60 onto the fixing roller 51 and the peripheral speed difference between the refreshing roller 60 and the fixing roller 51 may also be changed.

While the invention has been described with reference to the structures disclosed herein, it is not confined to the details set forth and this application is intended to cover such modifications or changes as may come within the purpose of the improvements or the scope of the following claims.

This application claims priority from Japanese Patent Application No. 190723/2011 filed Sep. 1, 2011, which is hereby incorporated by reference.

What is claimed is:

1. An image heating apparatus comprising:

a rotatable heating member configured to heat an image on a recording material in a nip;

a nip-forming member configured to form the nip together with said rotatable heating member;

a rotatable rubbing member configured to rub said rotatable heating member;

a temperature sensor configured to detect a temperature of said rotatable heating member;

a moving mechanism configured to move said rotatable rubbing member from a position where it is spaced from said rotatable heating member to a position where it rubs a surface of said rotatable heating member; and a controller configured to execute, by moving said rotatable rubbing member to the position where it rubs the surface of said rotatable heating member, a rubbing operation such that said rotatable rubbing member rubs the surface of said rotatable heating member, wherein said controller executes the rubbing operation depending on the temperature detected by said temperature sensor when the recording material passes through the nip.

2. An image heating apparatus according to claim 1, wherein said temperature sensor is provided opposed to an outside of a range in which a minimum-sized recording material passes through the nip with respect a widthwise direction.

3. An image heating apparatus comprising:

a rotatable heating member configured to heat an image on a recording material in a nip;

a nip-forming member configured to form the nip together with said rotatable heating member;

a rotatable rubbing member configured to rub said rotatable heating member;

a temperature sensor configured to detect a temperature of said rotatable heating member;

a moving mechanism configured to move said rotatable rubbing member from a position where it is spaced from said rotatable heating member to a position where it rubs a surface of said rotatable heating member; and a controller configured to execute, by moving said rotatable rubbing member to the position where it rubs the surface of said rotatable heating member, a rubbing operation such that said rotatable rubbing member rubs the surface of said rotatable heating member, wherein said controller executes the rubbing operation when a count value corresponding to a number of sheets of the recording material conveyed to the nip reaches a predetermined count, and executes the rubbing operation, even when the count value does not reach the predetermined count, when the temperature detected by said temperature sensor when the recording material passes through the nip reaches a predetermined temperature.

4. An image heating apparatus according to claim 3, wherein said temperature sensor is provided opposed to an outside of a range in which a minimum-sized recording material passes through the nip with respect a widthwise direction.

5. An image heating apparatus according to claim 3, wherein said controller increases the set count value when the temperature detected by said temperature sensor increases.

6. An image heating apparatus according to claim 3, wherein said controller controls said moving mechanism so that a rubbing time of said rotatable rubbing member on said rotatable heating member when the count value reaches the predetermined count is shorter than that when the temperature detected by said temperature sensor reaches the predetermined temperature.

7. An image heating apparatus according to claim 3, wherein said rotatable heating member has an elastic layer composed of a rubber material and a parting layer, composed of a fluorine-containing resin material, provided on a surface of the elastic layer, and wherein said rotatable rubbing member is a roller member having a surface on which abrasive grains are fixed and is rotationally driven with a peripheral speed difference with respect to a surface of said rotatable heating member.

8. An image heating apparatus comprising:

a rotatable heating member configured to heat an image on a recording material in a nip;

a nip-forming member configured to form the nip together with said rotatable heating member;

a rotatable rubbing member configured to rub said rotatable heating member;

a temperature sensor configured to detect a temperature of said rotatable heating member;

a moving mechanism configured to move said rotatable rubbing member from a position where it is spaced from said rotatable heating member to a position where it rubs a surface of said rotatable heating member; and a controller configured to execute, by moving said rotatable rubbing member to the position where it rubs the surface of said rotatable heating member, a rubbing operation such that said rotatable rubbing member rubs the surface of said rotatable heating member, wherein said controller executes the rubbing operation when a count value corresponding to a number of sheets of the recording material continuously conveyed to the nip reaches a predetermined count, and executes the rubbing operation, even when the number of sheets of the recording material conveyed to the nip does not reach the predetermined number of sheets, when the temperature detected by said temperature sensor when the recording material passes through the nip reaches a predetermined temperature.

9. An image heating apparatus according to claim 8, wherein said temperature sensor is provided opposed to an outside of a range in which a minimum-sized recording material passes through the nip with respect a widthwise direction.

* * * * *